US006603834B1

(12) United States Patent
Lu et al.

(10) Patent No.: US 6,603,834 B1
(45) Date of Patent: Aug. 5, 2003

(54) X-RAY TUBE ANODE COLD PLATE

(75) Inventors: Qing K. Lu, Aurora, IL (US); Todd R. Bittner, Chicago, IL (US); Allan D. Kautz, Naperville, IL (US); Gerald J. Carlson, Aurora, IL (US); Thomas R. Miller, St. Charles, IL (US); Jose A. Buan, Bolingbrook, IL (US); Salvatore G. Perno, Winfield, IL (US); Paul M. Xu, Oswego, IL (US); Patrick P. McNally, Geneva, IL (US)

(73) Assignee: Koninklijke Philips Electronics, N.V., Eindhoven (NL)

( * ) Notice: Subject to any disclaimer, the term of this patent is extended or adjusted under 35 U.S.C. 154(b) by 0 days.

(21) Appl. No.: 09/954,822

(22) Filed: Sep. 18, 2001

(51) Int. Cl.[7] ..... H01J 35/10
(52) U.S. Cl. ..... 378/141; 378/127; 378/130
(58) Field of Search ..... 378/119, 141, 378/142, 127, 130

(56) References Cited

U.S. PATENT DOCUMENTS 4,916,015 A * 4/1990 Schaffner et al. ..... 378/141
4,943,989 A * 7/1990 Lounsberry et al. ..... 378/141
5,185,774 A * 2/1993 Klostermann ..... 378/141
5,208,843 A * 5/1993 Marumo et al. ..... 378/141
5,416,820 A * 5/1995 Weil et al. ..... 378/141
5,978,447 A 11/1999 Carlson et al. ..... 378/123
6,041,100 A * 3/2000 Miller et al. ..... 378/141
6,377,659 B1 * 4/2002 Snyder et al. ..... 378/142
6,445,769 B1 * 9/2002 Panasik et al. ..... 378/141
2002/0085675 A1 * 7/2002 Snyder et al. ..... 378/141

* cited by examiner

*Primary Examiner*—Drew A. Dunn
(74) *Attorney, Agent, or Firm*—Fay, Sharpe, Fagan, Minnich & McKee, LLP

(57) ABSTRACT

An x-ray tube assembly (16) includes a housing (40) and an insert frame (54) supported within the housing (40), such that the insert frame (54) defines a substantially evacuated envelope in which a cathode assembly (60) and a rotating anode assembly (58) operate to produce x-rays. The rotating anode assembly (58) includes an anode target plate (64) coupled to a rotor (66) and bearing shaft (82), which is rotatably supported within a bearing housing (84), by a plurality of ball bearings (86). A heat barrier (90) substantially surrounds the bearing housing (84) and is coupled, along with the bearing housing (84) to an anode cold plate (100). The anode cold plate (100) includes a grooved cover (102), a basin (110), and a plurality of corrugated fins (120) disposed therein. Coupling both the bearing housing (84) and the heat barrier (90) to the anode cold plate (100) provides an effective means for cooling the bearing assembly (80).

18 Claims, 5 Drawing Sheets

X-RAY TUBE ANODE COLD PLATE

BACKGROUND OF THE INVENTION

The present invention relates to the x-ray tube art. It finds particular application in conjunction with x-ray tubes having straddle bearing anode assemblies for use with CT scanners and the like and will be described with particular reference thereto. It is to be appreciated, however, that the invention will also find application in conjunction with other bearing assemblies used in conventional x-ray diagnostic systems and other penetrating radiation systems for medical and non-medical examinations.

Typically, a high power x-ray tube includes an evacuated envelope made of metal or glass, which holds a cathode filament through with a heating current is passed. This current heats the filament sufficiently that a cloud of electrons is emitted, i.e., thermionic emission occurs. A high potential, on the order of 100–200 kV, is applied between the cathode and an anode assembly, which is also located within the evacuated envelope. This potential causes electrons to flow from the cathode to the anode assembly through the evacuated region within the interior of the evacuated envelope. The electron beam strikes the anode with sufficient energy that x-rays are generated. A portion of the x-rays generated pass through an x-ray window on the envelope to a beam limiting device or collimator, which is attached to an x-ray tube housing. The beam limiting device regulates the size and shape of the x-ray beam directed toward a patient or subject under examination, thereby allowing images of the patient or subject to be reconstructed.

In addition to generating x-rays, the impact of the electrons on the anode generates thermal energy. In order to distribute the thermal loading and reduce the anode temperature, a rotating anode assembly is often used. In this system, the electron beam is focused near a peripheral edge of the anode disk at a focal spot. As the anode rotates, a different portion of a circular path around the peripheral edge of the anode passes through the focal spot where x-rays are generated. The larger the diameter of the anode, the greater the cooling time before the electron beam strikes the same spot.

Typically, the anode is mounted on a shaft and rotated by a motor or drive. The anode, shaft, and other components rotated by the drive are part of a rotating assembly, which is supported by a bearing assembly. Bearing assemblies found in most x-ray tubes today utilize either a cantilevered bearing arrangement or a straddle bearing arrangement, in which the bearings are mounted to straddle the center of mass of the anode target. While the straddle bearing arrangement is effective for reducing mechanical stress and anode vibration on the bearings, it provides a challenge to cool the bearings and bearing assembly, which are located in the center zone and surrounded by the hot target.

The bulk temperature of the target during operation reaches approximately 1200° C., while the rotor temperature can reach about 500° C. Because of the high temperature difference between the target and rotor, heat conduction from the target to the rotor through the shaft can be substantial. In addition, the rotor and bearing assembly receives heat radiated from the target, leading to a rise in bearing temperature. As a key component of the rotor, the bearings must operate properly. A malfunction of the bearings leads to anode wobble, causing a distortion of the x-ray image, defocusing of the focal spot, and mechanical failure of the x-ray tube.

One prior method of bearing cooling involves a passive mode of heat transfer. More particularly, heat is transferred from the bearing balls or rollers through the bearing housing to be dissipated by the cooling fluid from the stem of the bearing housing. This method of heat dissipation has limited heat removal capacity due to a limited area between the stem and the cooling fluid and relative low activity of the fluid in the vicinity of the bearing housing. Another prior device includes a bearing housing having internal passages through which cooling oil is pumped. However, these passages are relatively narrow, making it difficult to provide adequate circulation and circulation velocity of the cooling oil. When the cooling oil dwells for too long a period of time in contact with hot surfaces, it overheats and carbonizes.

The present invention contemplates a new and improved x-ray tube assembly having a rotating anode assembly with an anode cold plate, which overcomes the above-referenced problems and others.

SUMMARY OF THE INVENTION

In accordance with one aspect of the present invention, an x-ray tube assembly includes an x-ray tube housing, a cathode assembly, and a rotating anode assembly. An insert frame, which is supported within the x-ray tube housing, defines a substantially evacuated envelope in which the cathode and anode assemblies operate to produce x-rays. An anode cold plate, which is disposed between the anode assembly and one end of the x-ray tube housing, is in thermal communication with the anode assembly.

In accordance with a more limited aspect of the present invention, the anode cold plate includes a cover having a top surface in thermal contact with the anode assembly and a basin connected to a peripheral portion of a bottom surface of the cover. The anode cold plate also includes an inlet tube disposed at a first end of the basin, which receives dielectric liquid coolant, and an outlet disposed at a second end of the basin.

In accordance with a more limited aspect of the present invention, the x-ray tube assembly further includes a heat barrier substantially surrounding and spaced apart from a bearing housing.

In accordance with another aspect of the present invention, a rotating anode x-ray tube includes an anode disk connected to a shaft, a bearing housing in which a plurality of bearing rotatably support the shaft, and a drive for rotating the shaft and anode disk. A heat barrier is substantially surrounding and spaced apart from the bearing housing. An anode cold plate assembly is disposed below and in thermal contact with the bearing housing and the heat barrier. A cathode is disposed opposite to and displaced from the anode disk. Further, the rotating anode x-ray tube includes an evacuated envelope within which the cathode, anode disk, shaft, bearing housing and heat barrier are at least partially disposed.

In accordance with a more limited aspect of the present invention, the anode cold plate assembly includes a cover having a top surface on which the bearing housing and heat barrier are mounted and a basin mounted to a peripheral portion of a bottom surface of the cover to define a chamber therebetween. An inlet tube is disposed at a first end of the basin for receiving liquid coolant and an outlet is disposed at a second end of the basin through which the liquid coolant exits the basin.

In accordance with another aspect of the present invention, an x-ray tube assembly includes a housing, an insert frame supported within the housing which defines an evacuated envelope in which a cathode assembly and a rotating anode assembly operate to produce x-rays. The rotating anode assembly includes a bearing assembly within a bearing housing and a heat barrier substantially surrounding the bearing housing. A method for cooling the bearing assembly includes positioning an anode cold plate in thermal contact with both the bearing housing and the heat barrier. In addition, cooling fluid flows into contact with an extended surface of the anode cold plate.

One advantage of the present invention resides in improved cooling of the bearing assembly.

Another advantage of the present invention resides in a cold plate integrated with the bearing housing.

Another advantage of the present invention resides in a heat barrier integrated with the bearing housing.

Yet another advantage of the present invention resides in enhanced liquid coolant flow velocity.

Other benefits and advantages of the present invention will become apparent to those skilled in the art upon a reading and understanding of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
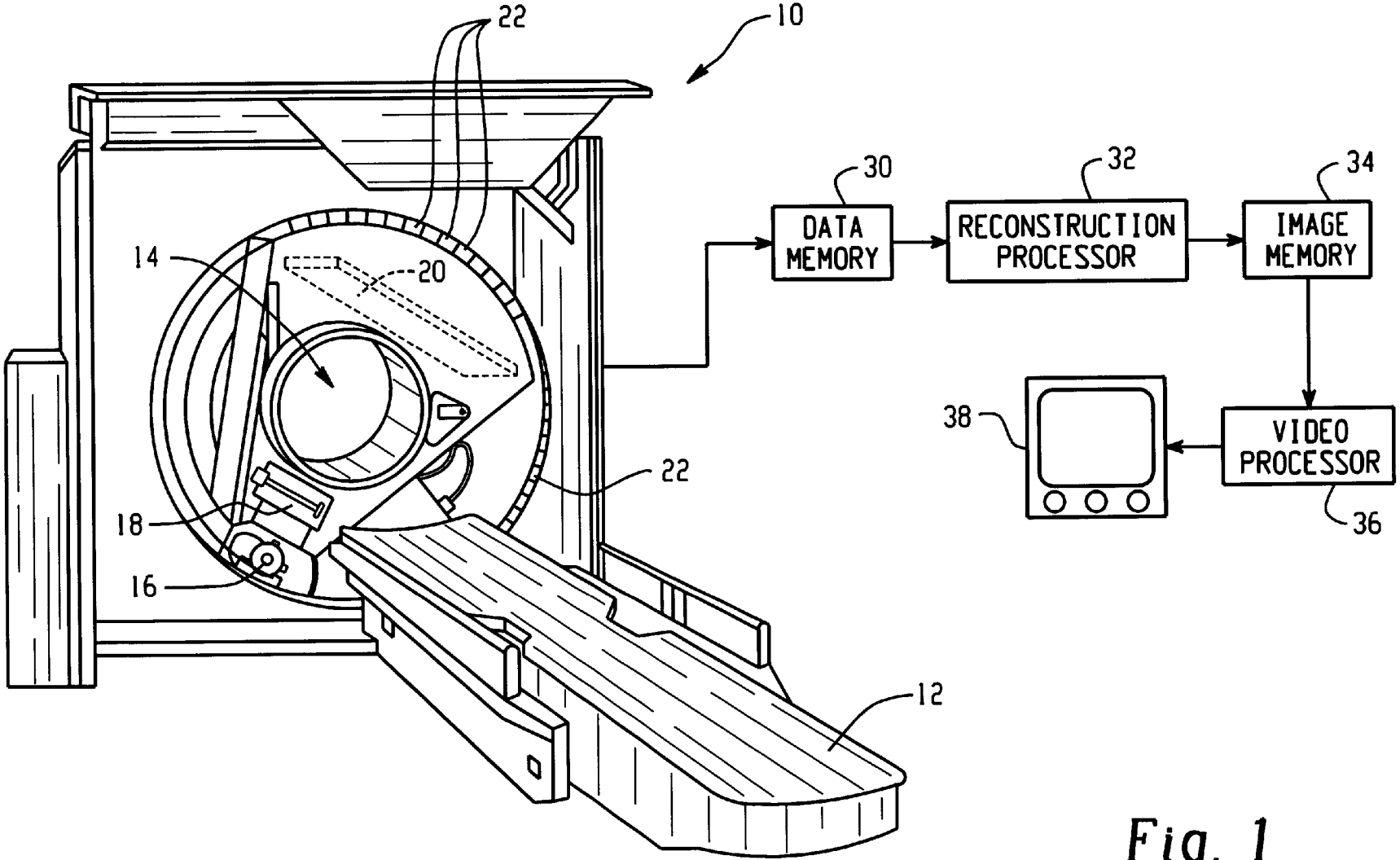
Fig. 1 PRIOR ART
FIG. 1 is a diagrammatic illustration of a prior art computerized tomographic (CT) diagnostic system employing the x-ray tube assembly in accordance with the present invention.

With reference to FIG. 1, a computerized tomographic (CT) scanner 10 radiographically examines and generates diagnostic images of a subject disposed on a patient support 12. More specifically, a volume of interest of the subject on the patient support 12 is moved into an examination region 14. An x-ray tube assembly 16 mounted on a rotating gantry projects one or more beams of radiation through the examination region 14. A collimator 18 collimates the beams of radiation in one dimension. In third generation scanners, a two-dimensional x-ray detector 20 is disposed on the rotating gantry across the examination region 14 from the x-ray tube. In fourth generation scanners, a ring or array of two-dimensional detectors 22 is mounted on the stationary gantry surrounding the rotating gantry.

Each of the two-dimensional x-ray detectors 20, 22 includes a two-dimensional array of photodetectors connected to or preferably integrated into an integrated circuit. The detectors generate electrical signals indicative of the intensity of the received radiation, which is indicative of the integrated x-ray absorption along the corresponding ray between the x-ray tube and the scintillation crystal segment.

The electrical signals, along with information on the angular position of the rotating gantry, are digitized by analog-to-digital converters. The digital diagnostic data is communicated to a data memory 30. The data from the data memory 30 is reconstructed by a reconstruction processor 32. Various known reconstruction techniques are contemplated including spiral and multi-slice scanning techniques, convolution and back projection techniques, cone beam reconstruction techniques, and the like. The volumetric image representations generated by the reconstruction processor are stored in a volumetric image memory 34. A video processor 36 withdraws selective portions of the image memory to create slice images, projection images, surface renderings, and the like, and reformats them for display on a monitor 38 such as a video or LCD monitor.

Figure 2:
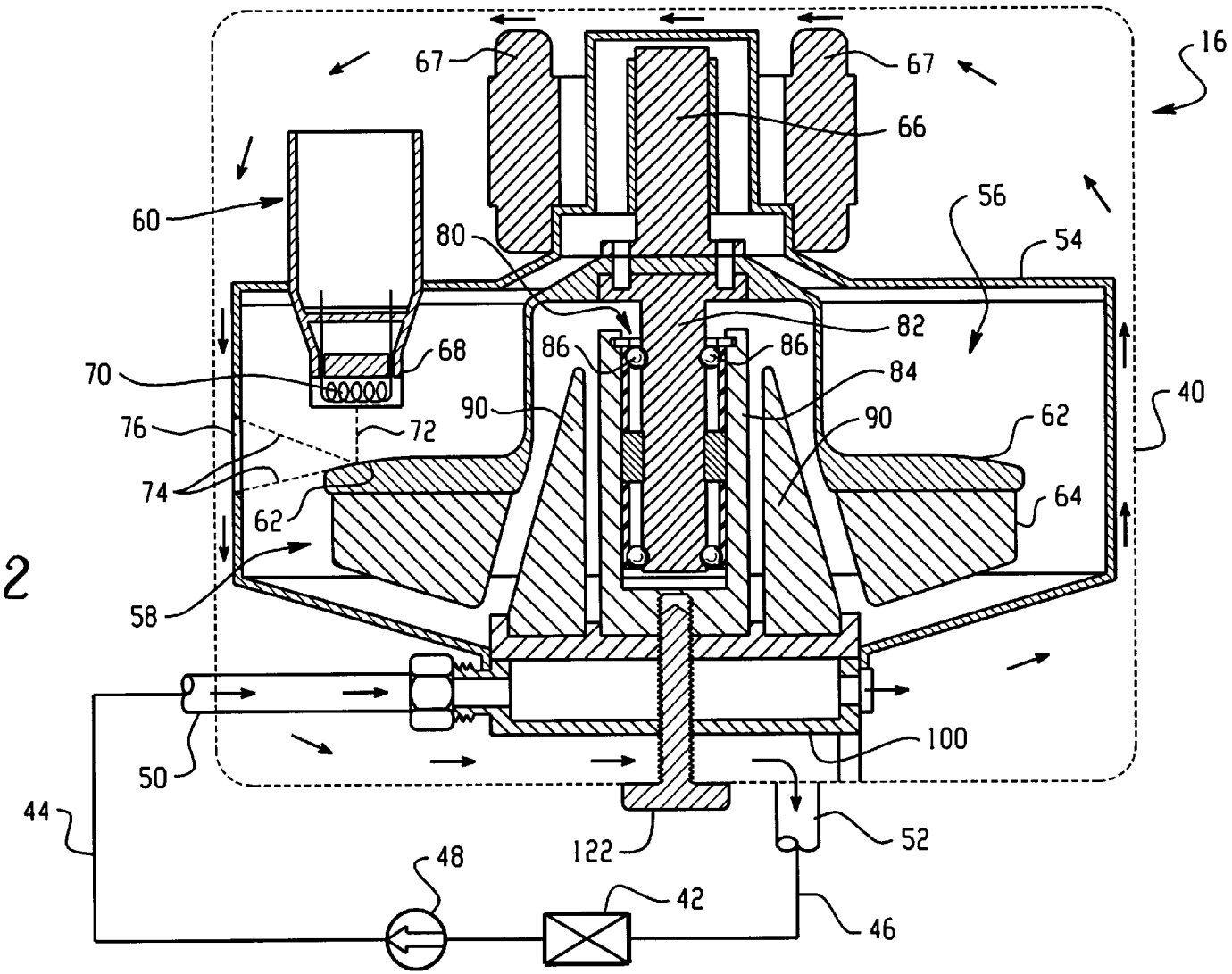
FIG. 2 is a diagrammatic illustration of a preferred embodiment of the x-ray tube assembly including an anode cold plate in accordance with the present invention.

With reference to FIG. 2 and continuing reference to FIG. 1, the x-ray tube assembly 16 includes a housing 40 filled with a heat transfer and electrically insulating cooling fluid, such as oil. More particularly, the cooling fluid (represented by the arrows) is circulated from within the housing 40 through a heat exchanger 42 and through circulation and return lines 44, 46 by a pump 48. The cooling fluid re-enters the housing through a housing inlet 50, circumnavigates the x-ray tube, and exits the housing through a housing outlet 52. An insert frame or envelope 54, preferably comprised of metal or ceramic, within which an evacuated chamber 56 is defined, is supported within the housing 40. A rotating anode assembly 58 and a cathode assembly 60 are disposed opposing each other within the evacuated chamber 56. An electron beam 72 passes from the cathode assembly 60 to a focal spot on an annular, circumferential race 62 of the anode plate or target 64. As is described more fully below, the anode assembly 58 is mounted to an induction motor assembly 66, 67 for rotation about an anode axis. The anode assembly includes a target area along a peripheral edge of the anode assembly, which is comprised of a high density tungsten composite or other suitable material for producing x-rays.

The cathode assembly 60 is stationary and includes a cathode focusing cup 68 positioned in a spaced relationship with respect to the target area 62. A cathode filament 70 mounted to the cathode cup 68 is energized to emit electrons 72, which are accelerated to the target area 62 of the anode assembly 58 in order to produce x-rays. The electrons from the cathode filament 70 are accelerated toward the anode assembly 58 by a large DC electrical potential difference between the cathode and anode assemblies. In one embodiment, the cathode is at an electrical potential of −100,000 volts with respect to ground, while the anode assembly is at an electrical potential of +100,000 volts with respect to ground, thereby providing a bipolar configuration having a total electrical potential difference of 200,000 volts. Impact of the accelerated electrons from the cathode filament 70 onto the focal spot of the anode assembly causes the anode assembly to be heated to a range of between 1,100°–1,400° C.

Upon striking the target area, a portion of the electrons reflect from the target area and scatter within the evacuated chamber of the envelope. The electrons which are absorbed, as opposed to reflected, by the anode assembly serve to produce x-rays 74 and heat energy. A portion of the x-rays pass through an x-ray window assembly 76, which is coupled to the envelope 54, towards a patient or subject under examination.

With continued reference to FIG. 2, the anode plate or target 64 of the rotating anode assembly 58 is mounted for rotation about an anode axis via a straddle bearing assembly 80. While the present invention is described with respect to a straddle bearing assembly, it is to be appreciated that it finds application in conjunction with other bearing assemblies and rotating anode assemblies. More particularly, the anode plate or target 64 of the anode assembly 58 is rigidly coupled to a bearing shaft 82 and a rotor 66 of the induction motor. The rotor 66 is electromagnetically coupled to drive coils 67 of the induction motor, for rotating the bearing shaft 82 and the anode plate 64 about an anode axis. The bearing assembly 80 includes a bearing housing 84 in which a plurality of ball or roller bearings 86 rotatably support the bearing shaft 82.

The rotating anode assembly 58 further includes a heat barrier 90 disposed substantially surrounding and spaced apart from the bearing housing 84, as shown in FIG. 2. In order to cool the bearing assembly and heat barrier, an anode cold plate 100 is disposed below and in thermal communication with the bearing housing 84 and the hear barrier 90.

Figure 3:
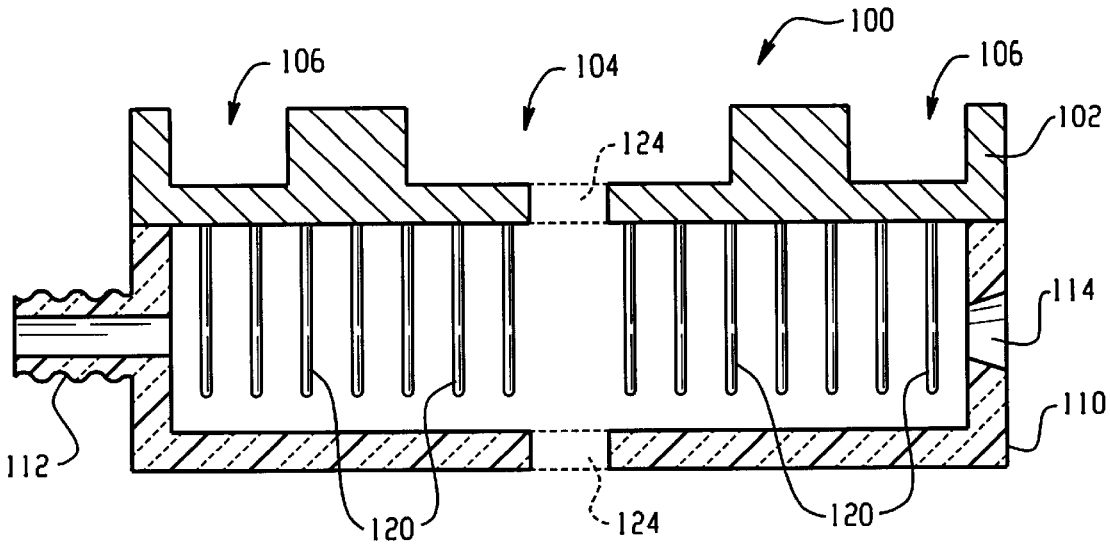
FIG. 3 is a side sectional view of a preferred embodiment of the anode cold plate in accordance with the present invention.
Figure 4:
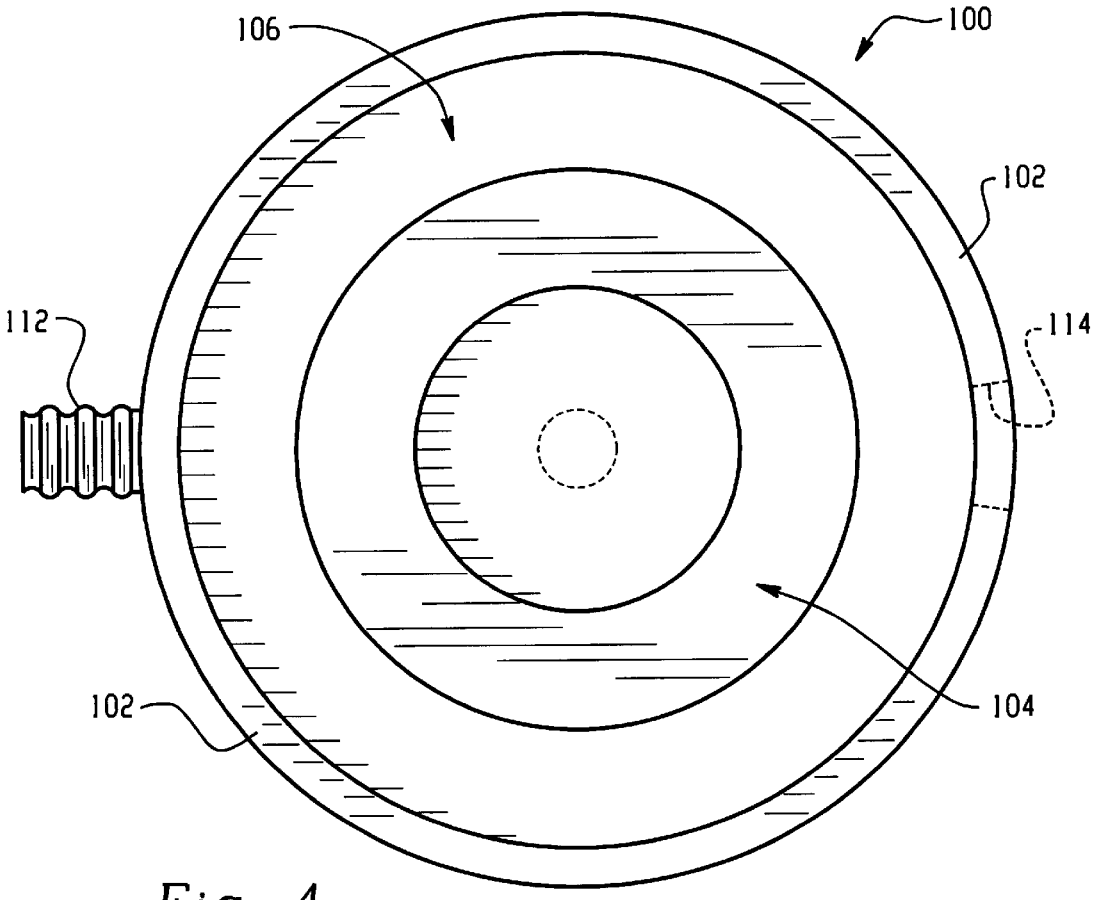
FIG. 4 is a top plan view of a preferred embodiment of the anode cold plate in accordance with the present invention.

With reference to FIGS. 3 and 4 and continuing reference to FIG. 2, the anode cold plate 100 includes a cover 102 having a grooved top surface. More particularly, the top surface of the cover includes two circular grooves 104, 106 which are adapted to receive bottom surfaces of the bearing housing 84 and the heat barrier 90, respectively. Preferably, the cover is made of copper or another highly thermal conductive material. The bearing housing 84 and heat barrier 90 are preferably brazed within the grooves 104, 106 on the top surface of the cover 102. A basin 110 is brazed to a peripheral portion of a bottom surface of the cover, as shown in FIG. 3. The basin 110 includes an inlet tube 112 disposed at a first end of the basin and an outlet 114 disposed at a second end of the basin. In order to insulate high voltage traveling from the anode to the cold plate, both the inlet tube 112 and the basin 110 are preferably made of alumina or another high voltage insulating material.

Preferably, a plurality of corrugated fins or other projections 120 are brazed to a bottom surface of the cover 102. The corrugated fins 120 provide an extended cooling surface for contact with a liquid coolant circulated through the basin of the anode cold plate. More particularly, both the cover and basin of the anode cold plate include center openings 124 through which an anode mounting bolt 122 passes. The mounting bolt 122 secures the cold plate 100 to both the housing 54 and the bearing housing 84.

As shown in FIG. 2, cooling fluid circulated through the heat exchanger 42 by the pump 48 flows through circulating line 44 through the housing inlet 50, into the inlet tube 112 of the anode cold plate. The cooling fluid absorbs heat from the bearing housing 84 and the heat barrier 90 through the finned cover of the cold plate. After exiting the cold plate through the outlet 114, the cooling fluid is directed to flow past the insert window, the insert frame, and other heat-dissipating components, as shown by the arrows. The cooling fluid then exits from the housing through the housing outlet 52 and returns to the heat exchanger 42 through return lines 46. Coupling both the bearing housing and the heat barrier to the anode cold plate provides an effective heat transfer unit possessing sufficient heat transfer surface area and a high convection coefficient. More particularly, this cooling assembly achieves a temperature reduction of approximately 125° C. in the bearing race.

Figure 5:
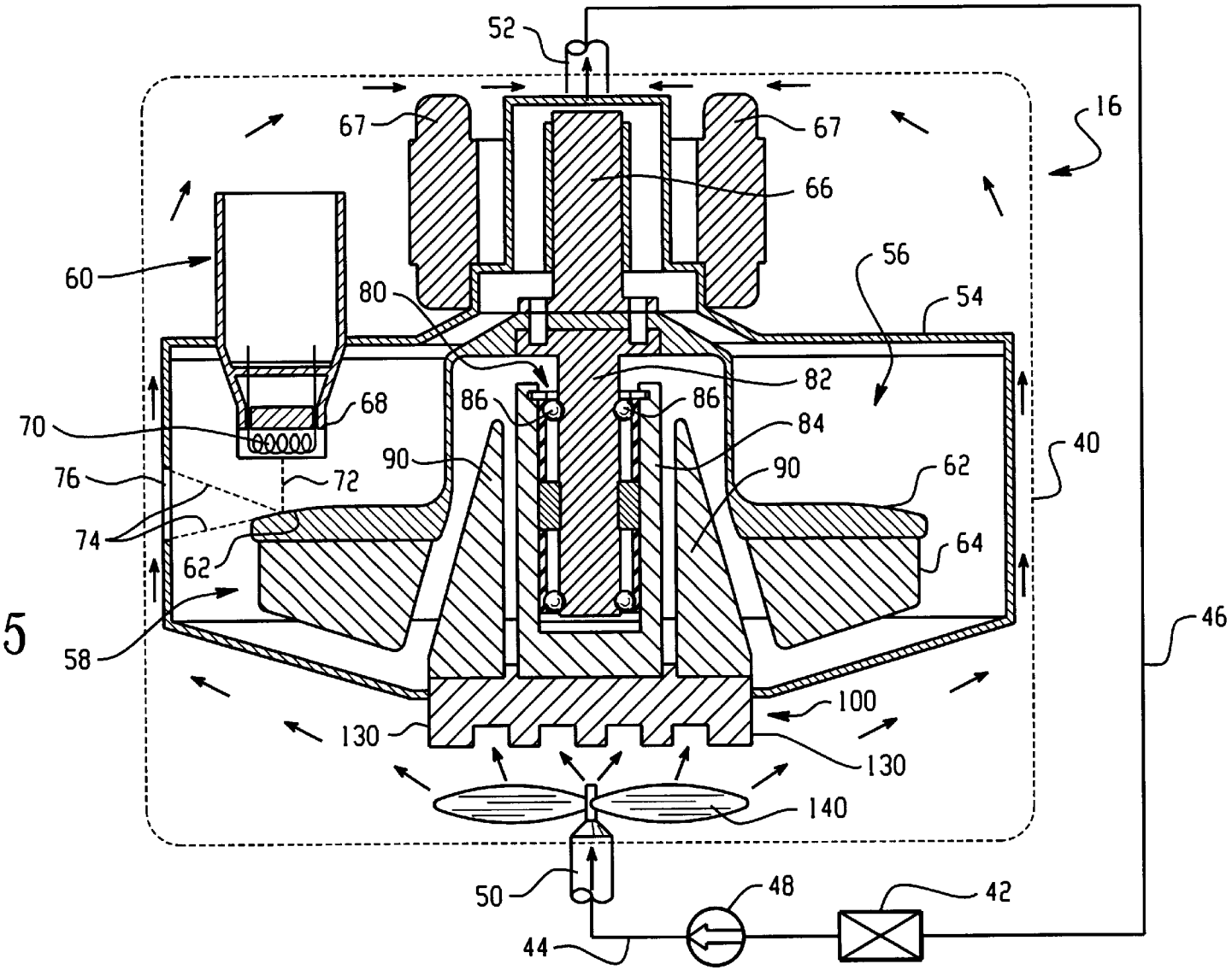
FIG. 5 is a diagrammatic illustration of another preferred embodiment of the x-ray tube assembly employing the anode cold plate in accordance with the present invention.
Figure 6:
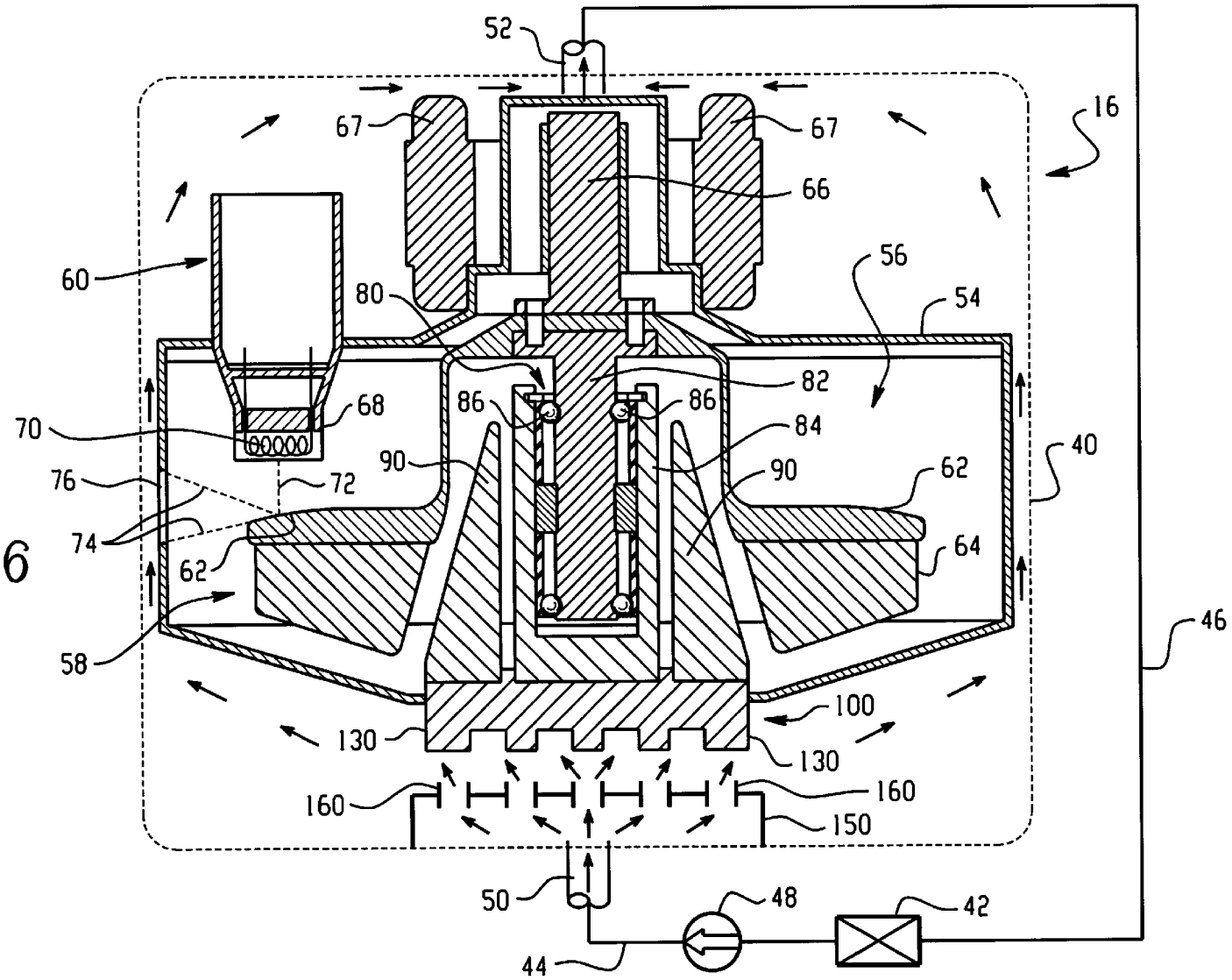
FIG. 6 is a diagrammatic illustration of another preferred embodiment of the x-ray tube assembly having the anode cold plate an accordance with the present invention.

With reference to FIGS. 5 and 6, and continuing reference to FIG. 2, where like reference numerals represent like elements, two alternate embodiments of the present invention are illustrated. In FIG. 5, the anode cold plate 100 is comprised of a continuous base plate, which extends from the bottom surfaces of the bearing housing 84 and the heat barrier 90, as shown. More particularly, the base plate 100 includes a grooved bottom surface 130, which provides an extended surface for contact with the cooling fluid. Preferably the bottom surface of the base plate includes a plurality of circular grooves machined into the base plate. Again, cooling fluid is circulated through a heat exchanger 42 by a pump 48, through a circulating line 44 and into the housing inlet 50. An impeller 140 is installed below the base plate. The impeller 140 rotates and forces the cooling fluid to flow over the grooved bottom surface 130 of the anode plate 100 with elevated velocity. The improved cooling fluid flow rates and the grooved surface enhances heat transfer from the bearing housing and heat barrier. After contacting the grooved surface 130, the cooling fluid continues to circulate between the insert frame 54 and the housing 40, out the housing outlet 52, through return line 46, and back into the heat exchanger 42.

With reference to FIG. 6, the impeller is replaced by a circular flow manifold 150 built at the housing inlet 50. The flow manifold 150 includes an array of nozzles or jets 160 mounted in the manifold facing the grooved bottom surface of the anode plate 100. As described above, cooling fluid is pumped into the manifold as a first entry into the x-ray tube housing. The fluid is then forced out of the manifold 150 through the nozzles 160 at an accelerated speed. The cooling fluid effectively sprays into the grooved surface 130 of the anode plate 100, cooling the bearing housing 84 and heat barrier 90. The combination of the rapidly flowing cooling fluid and the extended surface of the bearing housing and heat barrier enhance heat transfer between the bearing housing, heat barrier, and the fluid.

The invention has been described with reference to the preferred embodiment. Modifications and alterations will occur to others upon a reading and understanding of the detailed description. Is it intended that the invention be construed as including all such modifications and alterations insofar as they come within the scope of the appended claims or the equivalence thereof.

Having thus described the preferred embodiments, the invention is now claimed to be:

1. A rotating anode x-ray tube comprising:

an anode disk connected to a shaft;

a bearing housing in which a plurality of bearings rotatably support the shaft;

a drive for rotating the shaft and the anode disk;

a heat barrier substantially surrounding and spaced apart from the bearing housing;

a cover having a top surface on which the bearing housing and heat barrier are mounted;

a basin mounted to a peripheral portion of a bottom surface of the cover to define a chamber therebetween;

an inlet tube disposed at a first end of the basin which receives a liquid coolant;

an outlet disposed at a second end of the basin through which the liquid coolant exits the basin;

a cathode disposed opposite to and displaced from the anode disk;

an evacuated envelope within which the cathode, anode disk, shaft, bearing housing, and heat barrier are at least partially disposed.

2. A x-ray tube assembly comprising:

an x-ray tube housing;

a cathode assembly;

a rotating anode assembly;

an insert frame supported within the x-ray tube housing, said insert frame defining a substantially evacuated envelope in which the cathode and anode assemblies operate to produce x-rays; and an anode cold plate disposed between the anode assembly and one end of the x-ray tube housing, the anode cold plate including:

a cover having a top surface in thermal contact with the anode assembly;

a basin connected to a peripheral portion of a bottom surface of the cover;

an inlet tube disposed at a first end of the basin which receives dielectric liquid coolant; and an outlet disposed at a second end of the basin.

3. The x-ray tube assembly according to claim 2, wherein the anode cold plate further includes:

a plurality of corrugated cooling fins extending from the bottom surface of the cover.

4. The x-ray tube assembly according to claim 3, wherein the rotating anode assembly includes:

a bearing housing;

an anode target plate attached to a shaft and a rotor; and a plurality of bearings disposed in the bearing housing for rotatably supporting the shaft.

5. The x-ray tube assembly according to claim 4, further comprising:

a heat barrier substantially surrounding and spaced apart from the bearing housing.

6. The x-ray tube assembly according to claim 5, wherein the bearing housing and the heat barrier are connected to the top surface of the cover within a pair of circular grooves.

7. The x-ray tube assembly according to claim 4, wherein the anode cold plate is fastened to the x-ray tube housing and the bearing housing by a mounting bolt.

8. The x-ray tube assembly according to claim 3, further comprising:

a cooling system which circulates a dielectric liquid coolant through the anode cold plate.

9. The x-ray tube assembly according to claim 8, wherein the cooling system includes:

a heat exchanger and pump;

a cooling fluid circulation line in fluid communication with the pump and the inlet tube of the anode cold plate; and a cooling fluid return line in fluid communication with a housing outlet and the heat exchanger.

10. An x-ray tube assembly comprising:

an x-ray tube housing;

a cathode assembly;

a rotating anode assembly including:

an anode plate rigidly connected to a shaft and rotor;

a bearing housing in which a plurality of bearing rotatably support the shaft; and a heat barrier substantially surrounding and spaced apart from the bearing housing;

an insert frame supported within the x-ray tube housing, said insert frame defining a substantially evacuated envelope in which the cathode and anode assemblies operate to produce x-rays; and an anode cold plate including:

a base plate in thermal communication with and extending from bottom surfaces of (a) the bearing housing and (b) the heat barrier, said base plate having surface area increasing protrusions extending from the bottom surface.

11. The x-ray tube assembly according to claim 10, further including:

an impeller in fluid communication with a heat exchanger and a pump which forces liquid coolant in contact with the bottom surface of the base plate.

12. The x-ray tube assembly according to claim 10, further including:

a flow manifold containing an array of nozzles in fluid communication with a pump and a heat exchanger which forces liquid coolant in contact with the grooved bottom surface of the base plate.

13. A rotating anode x-ray tube comprising:

an anode disk connected to a shaft;

a bearing housing in which a plurality of bearings rotatably support the shaft;

a drive for rotating the shaft and the anode disk;

a heat barrier substantially surrounding and spaced apart from the bearing housing and disposed between the anode disk and the bearing housing;

an anode cold plate assembly mounted below and with one face in direct contact with (i) the bearing housing, and (ii) the heat barrier to move radiant heat intercepted by the heat barrier directly into the cold plate assembly, the anode cold plate having an opposite face over which a liquid coolant flows;

a cathode disposed opposite to and displaced from the anode disk;

an evacuated envelope within which the cathode, anode disk, shaft, bearing housing, and heat barrier one face are at least partially disposed, the heat barrier opposite face being disposed outside the evacuated envelope.

14. The rotating anode x-ray tube according to claim 13, wherein the anode cold plate assembly further includes:

a plurality of cooling projections in thermal contact with a bottom surface of the cold plate assembly.

15. The rotating anode x-ray tube according to claim 13, wherein the anode cold plate assembly further includes:

one of an impeller and nozzles disposed below the cold plate assembly for forcing the liquid coolant against the cold plate assembly.

16. In an x-ray tube assembly having a housing, an insert frame supported within the housing which defines an evacuated envelope in which a cathode assembly and a rotating anode assembly operate to produce x-rays, the rotating anode assembly including a bearing assembly within a bearing housing having a base surface and an annular heat barrier substantially surrounding the bearing housing and having an annular base surface, a method for cooling the bearing assembly including:

positioning a top surface of an anode cold plate in direct contact with (i) the bearing housing base surface and (ii) the heat barrier annular base surface; and flowing cooling fluid into contact with an extended undersurface of the anode cold plate which undersurface is disposed opposite the top surface and is coextensive therewith to transfer thermal energy from the bearing housing and the heat barrier into the cooling fluid.

17. The method according to claim 16, wherein the step of flowing the cooling fluid includes:

passing the cooling fluid through a heat exchanger and pump and into a passage of the anode cold plate, from the cold plate passage between the frame and the housing, and back to the heat exchanger.

18. The method according to claim 16, wherein the step of flowing the cooling fluid includes:

accelerating the cooling fluid and flowing the accelerated cooling fluid into contact with the cold plate.

* * * * *